US005420465A

United States Patent [19]

Wallace et al.

[11] Patent Number: 5,420,465

[45] Date of Patent: May 30, 1995

[54] SWITCHES AND SENSORS UTILIZING PULTRUSION CONTACTS

[75] Inventors: Stanley J. Wallace, Victor; John E. Courtney, Macedon; Wilbur M. Peck, Rochester; Joseph A. Swift, Ontario, all of N.Y.

[73] Assignee: Xerox Corporation, Stamford, Conn.

[21] Appl. No.: 297,734

[22] Filed: Aug. 30, 1994

Related U.S. Application Data

[62] Division of Ser. No. 809,118, Dec. 18, 1991, abandoned.

[51] Int. Cl.[6] ..... H01H 35/00

[52] U.S. Cl. ..... 307/116; 361/214

[58] Field of Search ..... 361/212, 214, 220, 221, 361/222; 307/116, 139; 200/11 R-11 TW, 275; 355/200, 210, 219, 251, 253

[56] References Cited

U.S. PATENT DOCUMENTS

| | | | |
|---|---|---|---|
| 3,568,145 | 3/1971 | Dikoff . | |
| 3,985,981 | 10/1976 | Weirick et al. . | |
| 4,336,565 | 1/1982 | Murray et al. | 361/225 |
| 4,358,699 | 11/1982 | Wilsdorf . | |
| 4,584,456 | 4/1986 | Oodaira et al. . | |
| 4,641,949 | 2/1987 | Wallace et al. . | |
| 4,694,138 | 9/1987 | Oodaira et al. . | |
| 4,761,709 | 8/1988 | Ewing et al. | 361/225 |
| 4,841,099 | 6/1989 | Epstein et al. . | |
| 4,894,500 | 1/1990 | Yamazaki et al. . | |
| 4,912,288 | 3/1990 | Atkinson et al. . | |
| 4,967,314 | 10/1990 | Higgins, III . | |
| 4,970,553 | 11/1990 | Orlowski et al. . | |
| 5,003,693 | 4/1991 | Atkinson et al. . | |
| 5,117,529 | 6/1992 | Ohta | 15/230.1 |
| 5,139,862 | 8/1992 | Swift et al. | 428/294 |
| 5,155,306 | 10/1992 | Iijima et al. . | |
| 5,177,529 | 1/1993 | Schroll et al. . | |
| 5,270,106 | 12/1993 | Orlowski et al. | 428/295 |

FOREIGN PATENT DOCUMENTS

| | | |
|---|---|---|
| 180378 | 5/1986 | European Pat. Off. . |
| 369772 | 5/1990 | European Pat. Off. . |
| 370818 | 5/1990 | European Pat. Off. . |

OTHER PUBLICATIONS

Maccorquodale, "Button Connectors-Solaerless, Low-Thermal Rise Interconnect for High-Speed Transmission", *Connection Technology*, Jan. 1990, pp. 25-28.

*Primary Examiner*—Jeffrey A. Gaffin
*Attorney, Agent, or Firm*—Oliff & Berridge

[57] ABSTRACT

Electronic switches and sensors have pultruded contact members. A switch includes first and second contact members, at least one of which including a pultruded contact member having an insulating body and a plurality of conductive fibers carried within the insulating body. The pultruded contact member is fibrillated at least at one end thereof to expose the conductive fibers for establishing electrical contact when brought into physical contact with the other of the first and second contact members. A sensor for detecting the presence of an article in a detection zone includes a contact at one side of the detection zone, and a pultrusion including a plurality of electrically conductive fibers and a host material carrying the plurality of fibers, supported at another end of the detection zone. One end of the pultrusion has a fibrillated end portion extending across the detection zone in electrical connection with the contact that is displaced by the article when the article is present in the detection zone to disconnect the electrical connection. The sensor is particularly well adapted to sense a sheet of paper or the like, for example, in an electrostatographic reproducing machine, and can be connected to a source of electrical potential so that the conductive fibers serve to discharge any static charges existing on the sheet of paper.

36 Claims, 5 Drawing Sheets

SWITCHES AND SENSORS UTILIZING PULTRUSION CONTACTS

CROSS REFERENCE TO RELATED APPLICATION

This is a division of application No. 07/809,118 filed Dec. 18, 1991, now abandoned.

Attention is directed to: 1) U.S. patent application Ser. No. 07/272,280 filed Nov. 17, 1988 by Swift et al, now abandoned and a continuation-in-part thereof entitled "Pultruded Electronic Device", U.S. Ser. No. 07/806,061 filed Dec. 11, 1991 and issued as U.S. Pat. No. 5,139,862 on Aug. 18,1992 (Attorney Docket D/87071l); and 2) U.S. patent application Ser. No. 07/516,000 filed Apr. 16, 1990 by Orlowski et al, and a continuation-in-part thereof entitled "Fibrillated Pultruded Electronic Component", U.S. Ser. No. 07/806/062 filed Dec. 11, 1991 and issued as U.S. Pat. No. 5,270,106 on Dec. 14, 1993. (Attorney Docket D/89397l); the disclosures of all of which are herein incorporated by reference.

BACKGROUND OF THE INVENTION

1. Field of the Invention

This invention relates to improvements in electronic sensors and switches, and, more particularly, to improvements in switch and sensor designs employing pultruded contact members. The invention also relates to a sensor using pultruded contact members to determine the presence of an object such as a sheet of paper in a detection zone.

2. Description of the Prior Art

Many switch and sensor designs and configurations have been proposed in the past. Generally most switches employ a movable member that carries a conductor in a manner such that it can be selectively brought into electrical contact with another conductor. Generally, most sensors employ two members having conductors in electrical contact, wherein the electrical contact is interrupted by the object to be sensed as the object passes between the members. The conductors are generally metal, but other conducive materials have been used as well.

As will become apparent, the invention has wide applications; however, a preferred embodiment of the invention is particularly suitable for applications in electrostatographic reproducing machines. In a typical electrostatographic reproducing machine, a photoconductive insulating surface, often in the form of a moving belt, is uniformly charged and exposed to a light image from an original document. The light image causes the exposed or background areas to become discharged, and creates an electrostatic latent image on the surface corresponding to the image contained within the original document. Alternatively, a light beam such as a laser beam may be modulated and used to selectively discharge portions of the photoconductive surface to record the desired information thereon. The electrostatic latent image is made visible by developing the image with a developer powder, referred to in the art as toner, which may be subsequently transferred to a support surface such as paper to which it may be permanently affixed by the application of heat and/or pressure.

In order to insure that the image is properly registered on the paper, switches or sensors are provided to detect the presence of the paper as it is moved through the various processing stages of the machine. However, because of the relatively hostile environment within such electrostatographic reproducing machines due to the presence of toner and other possible contaminants, the detecting switches and sensors need to be made sturdy and reliable, adding to the complexity and expense of the machine.

In addition, as the paper is moved though the machine, it may pick up stray or undesirable static charges that may interfere with the quality of the latent image, and ultimately the final image that is produced on it. Consequently, steps need to be taken to control such stray charges that may exist on the paper.

In many applications, it is desired to reduce the size of the switches and sensors that are used, but mechanical considerations limit the size of reduction that can be achieved. Moreover, many applications, such as, for example, in electrostatic reprographic machines, present hostile environments in which toner and other particulates exist, requiring the switch and sensor contacts be sufficiently large to insure reliable electrical connection when the contacts are brought together. In attempts to accomplish reliable switch and sensor structures, special expensive materials and designs have been proposed, yet room exists for further improvement toward achieving switches and sensors of miniature and microminiature design.

Another problem that exists, particularly with metal contacts, is that oxide often forms on the metal of the contacts, further reducing the reliability of the switch, particularly in hostile environments.

U.S. Pat. No. 4,641,949 describes the application of carbon fibers combined to form the basis of a non-metallic contact which in turn is the basis of a paper sensor.

SUMMARY OF THE INVENTION

In light of the above, it is, therefore, an object of the invention to provide improved electronic switches and sensors.

It is another object of the invention to provide improved switches and sensors of the type described that employ pultrusion contacts.

It is another object of the invention to provide improved electronic sensors and switches of the type described which can be provided at very low cost.

It is another object of the invention to provide improved electronic switches and sensors which can be assembled into connector headers.

It is another object of the invention to provide electronic sensors and switches which can be used to form miniature sized devices.

It is also an object of the invention to provide an electronic switch or sensor for detecting the presence of an object such as a sheet of paper for use in applications such as electrostatographic reproducing machines or the like.

It is another object of the invention to provide a switch or sensor of the type described, which, in addition to detecting the presence of a sheet of paper, also serves to discharge static charge on the surface of the paper.

These and other objects, features and advantages will become apparent to those skilled in the art from the following detailed description, when read in conjunction with the accompanying drawings and appended claims.

In accordance with a broad aspect of the invention, a switch is provided having two electronic contacts. One of the electronic contacts includes a pultrusion having a plurality of electrically conductive fibers carried by a host material. One end of the pultrusion has a fibrillated end portion to provide the electronic contact. One of the electronic contacts is movable into and out of electrical connection with another of the contacts. The host material can be a polymer from the group consisting of low molecular weight polyethylene, polypropylene, polystyrene, polyvinylchloride, and polyurethane polyimide composition that volatilizes rapidly and cleanly upon direct exposure to a laser beam of predetermined energy, and the continuous strand fibers can be carbon fibers.

In accordance with one embodiment of the invention, a switch is presented which has first, second, and third electronic contacts. A fourth electronic contact is formed of a pultrusion including a plurality of electrically conductive fibers and a host material carrying the plurality of fibers, one end of the pultrusion having a fibrillated end portion, which can be fan shaped, that is selectively movable to contact either the first and second electronic contacts or the second and third electrical contacts.

In accordance with another embodiment of the invention a switch is presented which has first and second pultrusions, which can be cylindrically shaped, each comprising a plurality of electrically conductive fibers and a host material carrying the plurality of fibers. One end of the pultrusion has a fibrillated end portion that presents a plurality of electrically conductive fibers that are arranged in the host material to be present only in selected areas at the fibrillated end portion. The first and second pultrusions are arranged in end to end relationship, and at least one of the first and second pultrusions is rotatable to selectively establish electrical connection between the electrically conductive fibers of the first and second pultrusions.

In accordance with still another embodiment of the invention, a switch is presented which has a selectively rotatable insulating substrate that has a conductive portion thereon. First and second pultrusions, each comprising a plurality of electrically conductive fibers and a host material carrying the plurality of fibers, are provided, one end of each of the pultrusions having a fibrillated end portion. The first and second pultrusions being arranged with the fibrillated end portions in contact with the substrate, whereby when the substrate is rotated, the conductive portion is brought into electrical contact with the fibrillated end portions of the pultrusions. In one embodiment, the fibrillated end portions of the first and second pultrusions are in contact with a face of the substrate along an axis parallel to an axis of rotation of the substrate, and in another embodiment, the substrate is disk shaped, and the fibrillated end portions of the first and second pultrusions are in contact with the substrate from an edge and along an axis perpendicular to an axis of rotation of the substrate.

In still another embodiment, in accordance with the invention, a switch is provided that has first and second pultrusions, each comprising a plurality of electrically conductive fibers and a host material carrying the plurality of fibers with one end of the pultrusion being fibrillated. An electrical contact is provided that is selectively movable into and out of contact with the fibrillated end portions of the first and second pultrusions. An arm may be provided to carry the electrical contact, the arm being rotatably mounted to enable the electrical contact to be selectively movable into and out of contact with the fibrillated end portions of the first and second pultrusions.

In accordance with a another aspect of the invention, a sensor is presented for detecting the presence of an article in a detection zone. The sensor includes a contact at one side of the detection zone, and a pultrusion including a plurality of electrically conductive fibers and a host material carrying the plurality of fibers, supported at another end of the detection zone. One end of the pultrusion has a fibrillated end portion with conductive fibers of the pultrusion extending across the detection zone in electrical connection with the contact. The fibers are displaced by the article when the article is present in the detection zone to disconnect the electrical connection. The sensor is particularly well adapted to sense a sheet of paper or the like, for example, in an electrostatographic reproducing machine, and can be connected to a source of electrical potential, or ground, so that the conductive fibers serve to establish a known charge or to discharge any static charges existing on the sheet of paper.

BRIEF DESCRIPTION OF THE DRAWING

A preferred embodiment of the invention is illustrated in the accompanying drawings in which:

FIG. 10 is a side elevation view of another embodiment of a switch or sensor for sensing the presence of a sheet of paper or the like.

Figure 1:
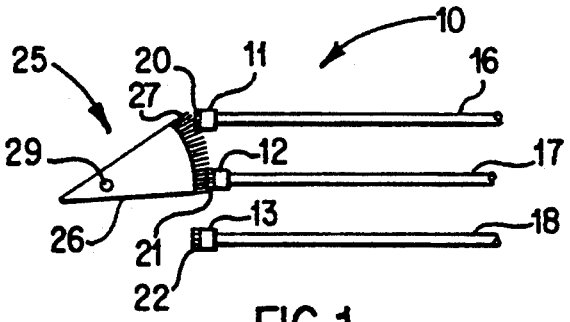
FIG. 1 is a side elevation view of an embodiment of a switch using a rotating pultruded member.

In the various figures of the drawing, the sizes and dimensions of the various parts have been exaggerated for clarity of description and ease of illustration.

DETAILED DESCRIPTION OF THE PREFERRED EMBODIMENTS

In accordance with the present invention, an electronic component is provided and a variety of electronic devices for conducting electrical current such as switches, sensors, etc. are provided which are of greatly improved reliability, are of low cost and easily manufacturable and are capable of reliably operating in low energy circuits. Typically these devices are low energy devices, using low voltages within the range of millivolts to hundreds of volts and currents within the range of microamps to hundreds of milliamps as opposed to power applications of tens to hundreds of amperes, for example. Although the present invention may be used in certain applications in the single amp region it is noted that best results are obtained in high resistance circuitry where power losses can be tolerated. It is also noted that these devices may be used in certain applications in the high voltage region in excess of 10,000 volts, for example, where excessive heat is not generated. These devices are generally electronic in nature within the generic field of electrical devices meaning that their principle applications are in signal level circuits although as previously stated they may be used in certain low power applications where their inherent power losses may be tolerated.

According to the present invention, an electronic component is made from a pultruded composite member having a fibrillated brush-like structure at one end which provides a densely distributed filament contact with another component. By the term densely distributed filament contact it is intended to define an extremely high level of contact redundancy insuring electrical contact with another contact surface in that the contacting component has in excess of 1000 individual conductive fibers per square millimeter.

In accordance with a preferred embodiment of the invention, the use of a pultrusion of the type having a plurality of conductive fibers carried within a host matrix (sometimes referred to as a distributed fiber pultrusion) serving as switch contacts is advanced. Switches and sensors employing this feature can be fabricated at very low cost, and, due to the inertness and reliability of the distributed fiber pultrusion contact, many new electronic device configurations which would have earlier been judged to be unreliable due to the application of metal contacts in open air can be enabled. With the realization that a pultruded carbon material can be used as both a connector pin and an element of a switch, it becomes apparent that miniature switches and sensors could be built, for example, into connector headers. The Molex 0.025 inch square pin and headers are examples of the configurations which are easily transformed by the distributed fiber contact materials into small, inexpensive switches and sensors. One overriding consideration is enabling the ability to manufacture miniature sensors and switches for virtually pennies, with high performance of the carbon fiber and carbon fiber pultrusion composites.

Such sensors and switches can serve a variety of applications within a xerographic engine and its peripherals, all enabled by pultrusion carbon fiber rods which are ordinarily rigid but through laser heating can expose conductive parts that are flexible and can be easily contacted for electrical connections, as below described in detail.

Thus, in accordance with the present invention, an improved electrical contact device is provided that is of improved reliability, is of low cost and is easily manufacturable. These advantages are enabled through the use of a manufacturing process known generally as a pultrusion process, with the fibrillation of at least one end of the pultrusion. One pultrusion composition that can be employed in practicing this invention is of the type that comprises continuous fibers or strands of resistive carbon fiber filler within a host polymer. Such carbon fiber pultrusions are a subcategory of high performance conductive composite plastics, and comprise one or more types of continuous, conductive reinforcing filaments in a binder polymer. They provide a convenient way to handle, process and use fine diameter, carbon fibers without the problems typically encountered with free conductive fibers.

The pultrusion process generally consists of pulling continuous lengths of fibers first through a resin bath or impregnator, then into a preforming fixture where the resulting section is at least partially shaped and excess resin and/or air are removed. The section is then pulled into heated dies where it is continuously cured. For a detailed discussion of pultrusion technology, reference is directed to "Handbook of Pultrusion Technology" by Raymond W. Meyer, first published in 1985 by Chapman and Hall, N.Y.

More specifically, in the practice of the invention, conductive carbon fibers are submersed in a polymer bath and drawn through a die opening of suitable shape at high temperature to produce a solid piece having dimensions and shapes of that of the die. The solid piece can then be cut, shaped, or machined. As a result, a structure can be achieved that has thousands of conductive fiber elements contained within the polymer matrix, the ends of the fiber elements being exposed to provide electrical contacts. The very large redundancy and availability of electrical contacts enables a substantial improvement in the reliability of these devices.

Since the plurality of small diameter conductive fibers are pulled through the polymer bath and heated die as a continuous length, the shaped member can be formed with the fibers being continuous from one end of the member to the other. Accordingly, The pultruded composite may be formed in a continuous length during the pultrusion process, then cut to any suitable dimension, with a very large number of potential electrical contacts provided at each end. Such pultruded composite members may have either one or both of its ends subsequently fibrillated.

Any suitable fiber having a high resistivity may be used in the practice of the invention. Typically, the conductive fibers are nonmetallic and have a DC volume resistivity of from about $1\times10^{-5}$ to about $1\times10^{10}$ ohm-cm and preferably from about $1\times10^{-4}$ to about 10 ohm-cm to minimize resistance losses and suppress RFI. The upper range of resistivities of up to $1\times10^{10}$ ohm-cm. could be used, for example, in those special applications involving extremely high fiber densities where the individual fibers act as individual resistors in parallel thereby lowering the overall resistance of the pultruded member enabling current conduction. The vast majority of applications however, will require fibers having resistivities within the above stated preferred range to enable current conduction. The term "nonmetallic" is used to distinguish from conventional metal fibers which exhibit metallic conductivity having resistivity of the order of $1\times10^{-6}$ ohm-cm and to define a class of fibers which are nonmetallic but can be treated in ways to approach or provide metal like properties. Higher resistivity materials may be used if the input impedance of the associated electronic circuit is sufficiently high. However, carbon fibers are particularly well suited as preferred filler because they are chemically and environmentally inert, possess high strength and stiffness, can be tailored to virtually any desired resistivity, and exhibit a negative coefficient of thermal resistivity.

In addition, the individual conductive fibers can be made circular in cross section with a diameter generally in the order of from about 4 micrometers to about 50 and preferably from about 7 micrometers to 10 micrometers. This provides a very high degree of redundancy in a small cross sectional area. Thus, as contact materials, the fibers provide a multiple redundancy of contact points, for example, in the range between about $0.05\times10^5$ and $5\times10^5$ contacts/cm$^2$. This is believed to enable ultrahigh contact reliability. Moreover, for instance, in electrostatic reproducing machines, such fibers are also are likely to minimize harmful contamination within the machines.

The fibers are typically flexible and compatible with the polymer systems within which they are carried. Typical fibers may include carbon, carbon/graphite, metalized or metal coated carbon fibers and metal coated glass fibers. A particularly preferred class of fibers that may be used are those fibers that are obtained from controlled heat treatment processing to yield complete or partial carbonization of polyacrylonitrile (PAN) precursor fibers. It has been found for such fibers that by carefully controlling the temperature of carbonization within certain limits that precise electrical resistivities for the carbonized carbon fibers may be obtained. The carbon fibers from polyacrylonitrile (PAN) precursor fibers are commercially produced by the Stackpole Company, Celion Carbon Fibers, Inc., division of BASF and others in yarn bundles of 1,000 to 160,000 filaments. The yarn bundles are carbonized in a two-stage process. The first stage involves stabilizing the PAN fibers at temperatures of the order of 300° C. in an oxygen atmosphere to produce preox-stabilized PAN fibers. The second stage involves carbonization of the fibers at elevated temperatures in an inert atmosphere, such as an atmosphere containing nitrogen. The DC electrical resistivity of the resulting fibers is controlled by the selection of the temperature of carbonization. For example, carbon fibers having an electrical resistivity of from about $10^2$ to about $10^6$ ohms-cm are obtained if the carbonization temperature is controlled in the range of from about 500° C. to 750° C. while carbon fibers having D.C. resistivities of $10^{-2}$ to about $10^{-6}$ ohm-cm result from treatment temperatures of 1800° to 2000° C. Further, carbon fibers having an electrical resistivity of from about $10^6$ Ω·cm to $10^{10}$ Ω·cm are obtained if the carbonization temperature is controlled in the range of from about 750° C. to about 1150° C. For further reference to the processes that may be employed in making these carbonized fibers attention is directed to U.S. Pat. No. 4,761,709 to Ewing et al and the literature sources cited therein at column 8. Typically these carbon fibers have a modulus of from about 30 million to 60 million psi or 205-411 GPa which is higher than most steels thereby enabling a very strong pultruded composite member. The high temperature conversion of the polyacrylonitrile fibers results in a fiber which is about 99.99% elemental carbon which is inert and will resist oxidation.

One of the advantages of using conductive carbon fibers is that they have a negative coefficient of thermal conductivity so that as the individual fibers become hotter with the passage of, for example, a spurious high current surge, they become more conductive. This provides an advantage over metal contacts since metals operate in just the opposite manner and therefore metal contacts tend to burn out or self destruct. The carbon fibers have the further advantage in that their surfaces are inherently rough and porous thereby providing better adhesion to the polymer matrix. In addition, the inertness of the carbon material yields a contact surface relatively immune to contaminants of the plated metal.

The carbon fibers are enclosed in any suitable polymer matrix. The polymer matrix should be of a resin binder material that will volatilize rapidly and cleanly upon direct exposure to the laser beam during laser processing below described. Polymers such as low molecular weight polyethylene, polypropylene, polystyrene, polyvinylchloride, and polyurethane may be particularly advantageously employed. Polyesters, epoxies, vinyl esters, polyetheretherketones, polyetherimides, polyethersulphones and nylon are in general, suitable materials with the polyesters and vinylesters being preferred due to their short cure time, relative chemical inertness and suitability for laser processing.

A laser (not shown) can be used to both cut individual components for use as an electrical switch or sensor contact. For example, a focused laser can be used to cut the pultrusion and simultaneously volatilize the binder resin in a controlled manner a sufficient distance back from the cut to produce in one step a distributed filament contact. The length of exposed carbon fiber can be controlled by the laser power and cut rate. Various tip shapes can be achieved by changing the laser incidence angle. Thus, a suitable protrusion can be cut by laser techniques to form a contact of desired length from the longer pultrusion length, and both severed ends can be fibrillated to provide a high redundancy fiber contact member downstream for contact to electrical circuitry to be switched, and a high redundancy fiber contact upstream to contact a switch or sensor contact plate. Any suitable laser can be used which will be absorbed by the matrix of the host polymer, so that the host polymer will be volatilized. Specific lasers which may be used include a carbon dioxide laser, the YAG laser, or the argon ion laser. The carbon dioxide laser mentioned is particularly suited for this application, however, since it is the most reliable, best suited for polymer matrix absorption, and is most economical in manufacturing environments.

Still more particularly, as shown in FIG. 1, a switch embodiment 10, in accordance with a preferred embodiment of the invention, can be formed entirely of carbon fiber pultrusions 11, 12, and 13, or alternatively, a square carbon fiber pultrusion, for instance, of 0.025 inch on a side may be used. The pultrusions 11, 12, and 13 are pressed onto metal pins 16, 17, and 18, respectively, and mating contact is by the fibrillated carbon fiber ends 20, 21, and 22 to take up mounting tolerances. Three rods 16, 17, and 18 are shown, for example, which are to be interconnected in a desired combination. For example, in the embodiment illustrated, the top rod 16 serves as a normally closed contact rod and the center rod 17 serves as a common line contact rod. The pultrusions 11 and 12 of the top and center pins 16 and 17 are connected together by a contact or wiper assembly 25 formed of a pultrusion 26 of electrically conducting fibers 27 that have been fibrillated along a surface to form a fan shaped conductive portion having a circumference sufficient to encompass the two spaced contact rods 16 and 17. The wedge shaped assembly 25 is rotatably mounted to a pin 29 to enable suitable rotation thereof.

The bottom contact rod 18 illustrated serves as a normally open circuit contact rod, connection to which being established when the wiper assembly 25 is rotated to the appropriate location. Thus, for example, in the position shown, the conductive fibers 27 of the pultrusion 26 forming the wiper assembly are in contact with the normally closed contact 11 and the common contact 12. By clockwise rotation, on the other hand, the conductive fibers 27 are brought into contact with the common contact 12 and the contact 13 of the normally open connector rod 18 to establish the electrical connection therebetween.

The wedge or fan shaped contactor assembly 25 can be from a pultrusion formed of a body of insulating material of desired shape carrying a plurality of conductive fibers therein. The fibers 27 are shorted or electrically connected together within the interior of the body, and are exposed at the contact end of the wiper assembly, for example, by heat removal of the insulating portion of the pultrusion, such as by exposure to a laser beam such as an argon or carbon dioxide laser, as described above.

It will be appreciated that various other configurations of switch elements of the type described can be employed in other switch applications, it being intended that the invention not be limited to the wedge shaped pultruded member contact member illustrated.

Figure 2:
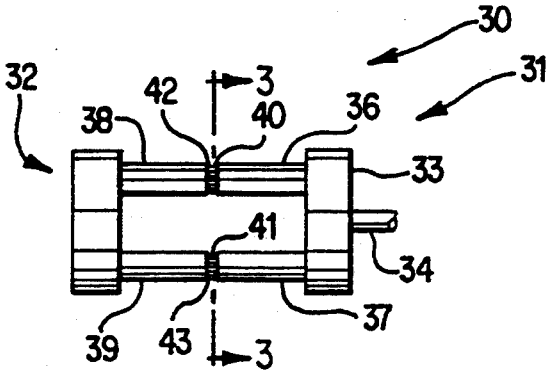
FIG. 2 is a side elevation view of another embodiment of a switch utilizing semicircular shaped pultruded members.
Figure 3:
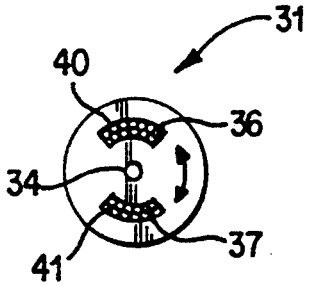
FIG. 3 is end elevation view of the switch of FIG. 2 taken at 3—3.

Another switch embodiment 30, in accordance with another embodiment of the invention, is shown in FIGS. 2 and 3. As shown, the switch is contained in a pair of mating cylinder or barrel assemblies 31 and 32 that may be biased against one another by a spring or other biasing means (not shown). One of the cylinders 31 includes a base member 33 that is rotatable on an axle 34 with respect to the other cylinder assembly 32. Each cylinder assembly 31 and 32 includes a pair of pultrusions 36,37 and 38,39, respectively, each formed of an insulating body in which is contained a plurality of conductive fibers, arranged along the length of the cylinder. The conductive fibers are arranged in a desired pattern, such as the semi-circular pattern shown in FIG. 3, when viewed from an end of the cylinder, and are fibrillated at the ends of the pultrusions, so that as the cylinder assembly 31 is rotated with respect to the other cylinder assembly 32, the fibers 40,41 of the cylinder assembly 31 can be brought into and out of contact with corresponding fibers 42,43 of the other cylinder assembly 32.

Connections can be made at a distal end of the fibers to desired circuitry (not shown). Additionally, it should be noted that the embodiment shown includes a pair of pultrusions each carrying respective sets of conductive fibers which are switchably interconnectable with corresponding fibers of the other cylinder. However, those skilled in the art will appreciate that the fibers of one of the cylinders can be merely conductive plates or conductive portions of a substrate to serve as the contacts for selectable interconnection with the conductive fibers of the pultrusion of the other cylinder, and that various other patterns or arrangements of the pultrusions can be equally advantageously employed.

Figure 4:
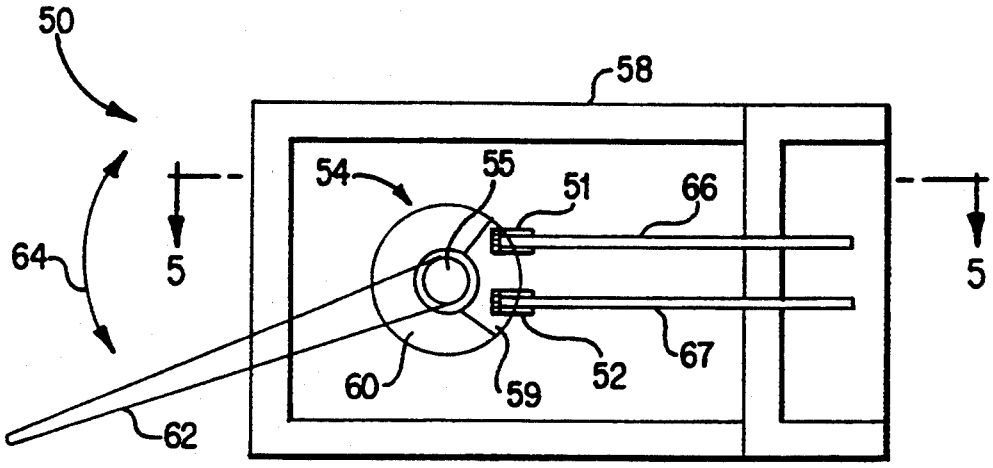
FIG. 4 is a side elevation of a single pole single throw switch using pultruded contact members for contacting a rotary disc contact.
Figure 5:
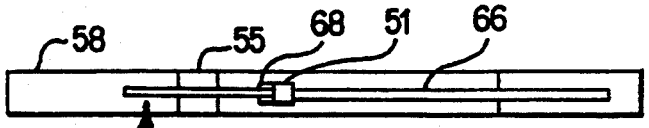
FIG. 5 is a top cutaway view taken at 5—5 in FIG. 4.
Figure 6:
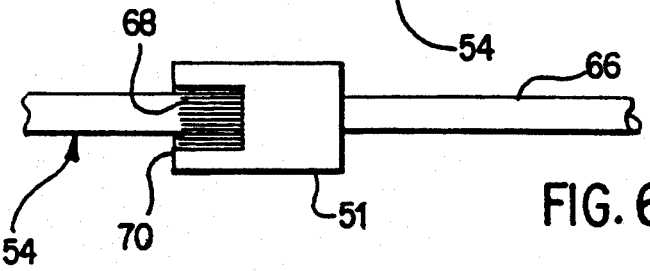
FIG. 6 is an enlarged top elevation view of a portion of the switch of FIG. 4 illustrating the contact between the segmented disc and pultruded sleeve contact.

Another embodiment 50 of a switch in accordance with the invention is shown in FIGS. 4–6. The switch 50 employs carbon fiber pultrusions 51 and 52 as a contact mediums, and includes a disc 54 rotatably mounted on an axle 55 within a switch enclosure 58. The disc 54 includes a portion 59 of conducting material and a portion 60 of non-conductive material, and is attached to a lever 62 to enable the disc 54 to be rotated in the direction shown by the arrow 64.

Two disc contacting pultrusions 51 and 52 are provided within the enclosure, 58 each including a pultruded contact carried upon a respective conductive tube or wire 66 and 67 for connection to the circuit (not shown) to be switched. As shown particularly in FIG. 6, the pultrusion portion of the contact is formed of an insulating body in which a number of conductive fibers 68 are carried, the conductive fibers 68 being electrically connected to the bar or rod 66 upon which the pultrusion 51 is carried slot 70 is formed in the end of the pultrusion 51 to expose the conductive fibers 68 within the pultrusion 51 for contact with the disc 54. The slot 70 can be formed, for example, by laser beam exposure or other selective heating means to remove the insulating portion of the pultrusion matrix. The other pultrusion 52 can be similarly formed.

Thus, in operation, when the switch lever 62 is moved to rotate the disc 54, the conductive portion 59 of the disc 54 is brought into or out of connection with one or both of the pultruded contact members 51 and 52 within the enclosure 58.

It will be appreciated by those skilled in the art that although the pultruded contact members 51 and 52 in the embodiment illustrated in FIGS. 4–6 are shown in contact with the edge of the disc 54, the pultrusion members could equally advantageously be mounted along an axis parallel to the axis of the rotation of the disc 54 to contact a top or bottom surface of the disc member without affecting the nature of operation of the switch.

Figure 7:
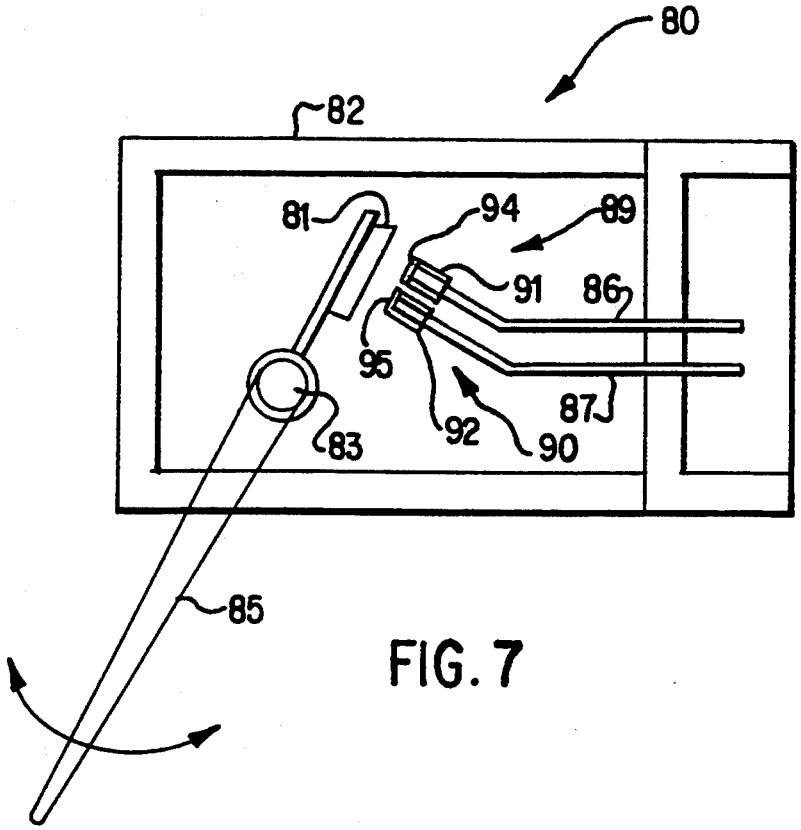
FIG. 7 is a front elevation view of another switch embodiment, in accordance with the invention, in which a contact plate is movably brought into contact with a plurality of pultruded contact members.

Another switch embodiment 80, in accordance with another preferred embodiment of the invention, is shown in FIG. 7. The switch 80 includes a contact member 81 rotatably carried within a housing 82 and rotatably movable about an axle 83 by operation of a lever 85. A pair of conductive rods 86 and 87 are also carried within the housing 82, each conductive rod 86 and 87 having at its contact end a respective pultruded contact member 89 and 90. Each of the pultruded contact members 89 and 90 is formed of an insulating body 91 and 92 containing a plurality of conductive fibers 94 and 95 in electrical contact with the respective rods 86 and 87 on which they are carried. The ends of the contact members have been fibrillated by a laser or other heating means to remove the insulating portion of the bodies 91 and 92 of the pultruded members 89 and 90 to expose the conductive fibers 94 and 95 carried within the insulating bodies 91 and 92. The pultruded contact members 89 and 90 are arranged so that upon operation of the lever 85 and rotation of the rotatable contact member 81, the rotatable contact member 81 is brought into contact with the exposed fibers 94 and 95 of the pultruded contact members 91 and 92 carried on the rods 86 and 87 to close the circuit between the two.

Figure 8:
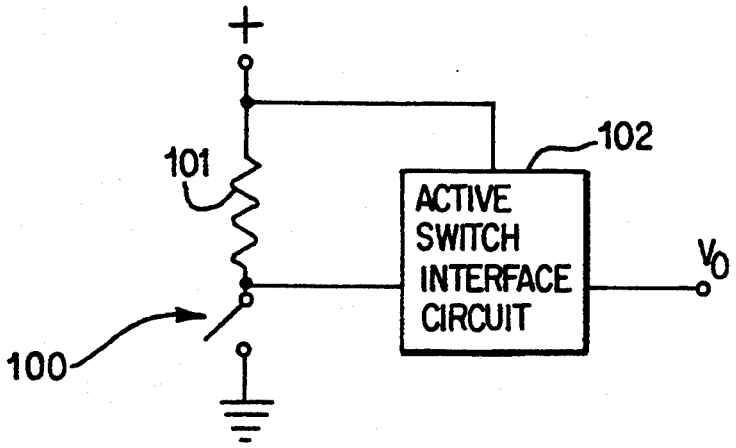
FIG. 8 is a schematic diagram of an electrical circuit in which a switch fabricated in accordance with the principles of the present invention is employed.

An example of an electronic circuit in which a switch fabricated in accordance with the principles of the invention as above described is shown in FIG. 8. As shown, a switch 100 which may include one or more elements of a carbon fiber pultrusion as described above, is shown in a series circuit between a power supply voltage and ground, including a switch biasing resistor 101. An active switch interface circuit 102 is connected across the resistor 101 to provide a signal on an output node, $V_O$ in accordance with the state of the switch 100, i.e., open or closed. It can be seen that the addition of an active interface circuit 102 to the carbon fiber switch 100 comprised of combinations of free and pultruded carbon fiber materials produces robust switching action, while providing a clean, predictable output response.

Figure 9:
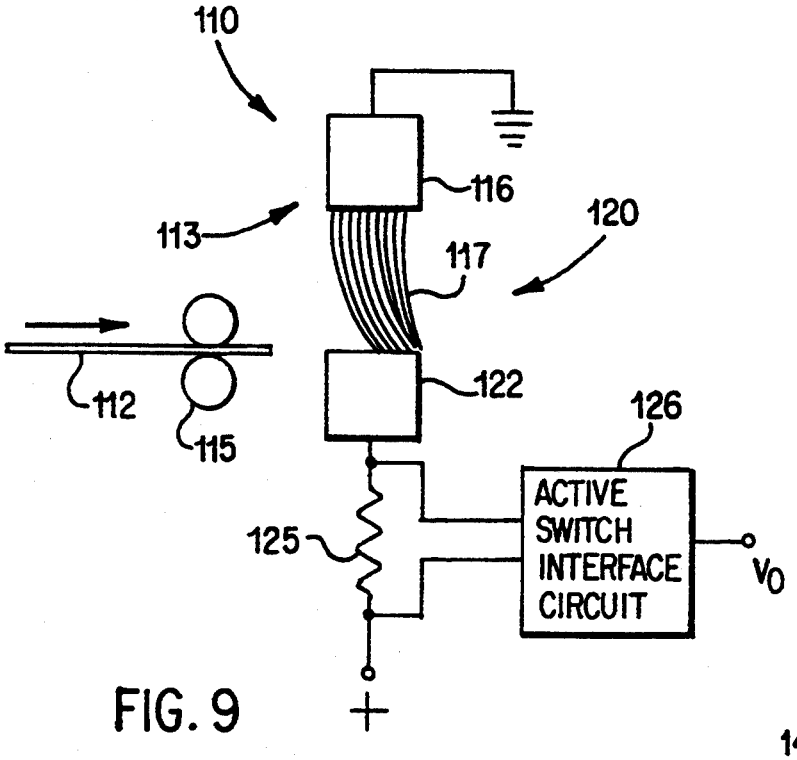
FIG. 9 is a side elevation view of a switch or sensor for sensing the presence of a sheet of paper or the like, in accordance with another preferred embodiment of the invention, including an electrical schematic diagram of an active chip level interfacing circuit for use therewith.

A preferred embodiment of sensor 110 is shown in FIG. 9. The embodiment of the switch 110 shown is particularly suitable for use in detecting the presence of an object, such as a sheet of paper 112 or the like passing through the switch 110. Such switches have widespread applications, one of which being use in electrostatographic reproducing machines or the like in which the position of a sheet of moving paper needs to be detected or monitored as it is moved through the machine. More particularly, the switch 110 includes a pultruded member 113 carried upon a part of the apparatus (not shown) through which the paper 112 whose presence is to be detected is moved by rollers 115 or other moving means. The pultruded member 113 is formed in a manner described above in detail, and includes an insulating body 116 carrying therewithin a number of conductive fibers. One end of the pultruded member 113 has been fibrillated by a laser (not shown) or the like to expose the contained fibers 117 for a predetermined length sufficient to traverse the path or detection zone 120 through which the paper or item to be detected is moved. The fibers 117 extend in their normal position to contact a conductive member 122 on the other side of the detection zone 120. The conductive member 122 can be either a pad of conductive material, as shown, or can be a second pultrusion fabricated in a manner similar to that of the pultruded member 113 described above.

Electrical connections may be made to the conductive fibers 117 and to the bottom conductive member 122 to detect the continuity of the switch 120, i.e., whether it is open or closed. To this end, a source of potential can be applied to the bottom contact 122 via a sense resistor 125, and the conductive filaments 117 of the pultrusion 113 can be connected to a reference potential or ground. Thus, a current path normally exists between the source of potential, the resistor 125, the switch formed by the pultrusion 113 and the conductive pad 122 to ground, and the voltage developed thereby on the sense resistor 125 can be detected, for example by an active switch interface circuit 126 to produce a signal on an output node, $V_O$. When a sheet of paper 112 or other item whose presence is to be detected traverses through the detection zone bridged by the fibers 117 of the pultrusions 113, the electrical current path is broken, thereby indicating the presence of the paper.

Figure 14:
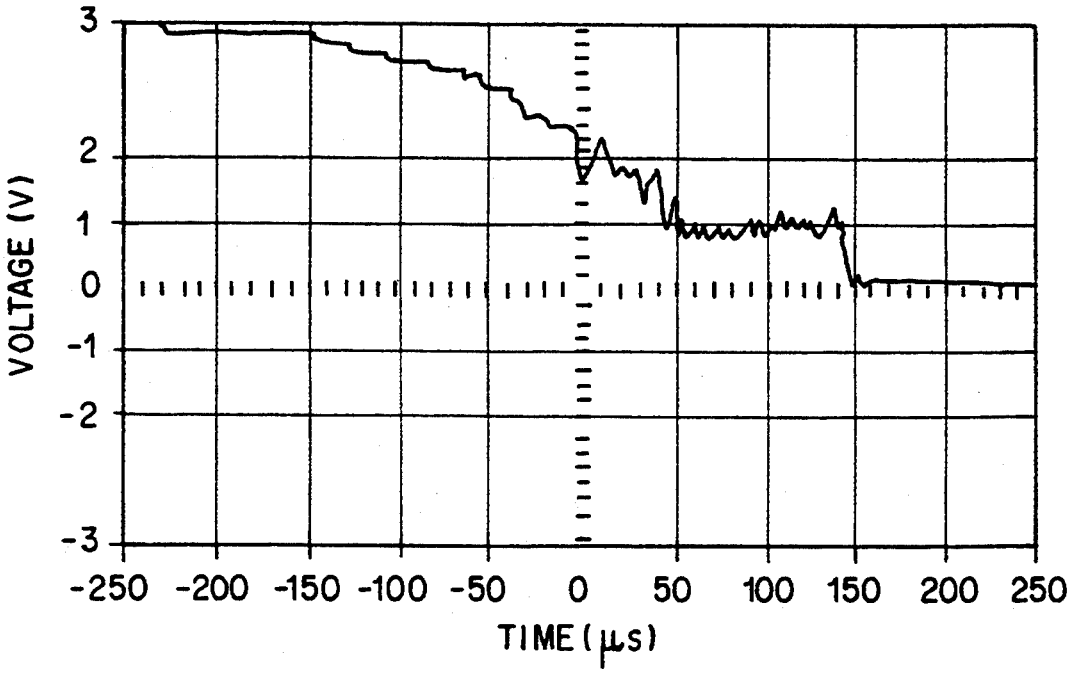
FIG. 14 is a graph illustrating the output waveform of fibers falling on an opposing contact without an active interface circuit.
Figure 15:
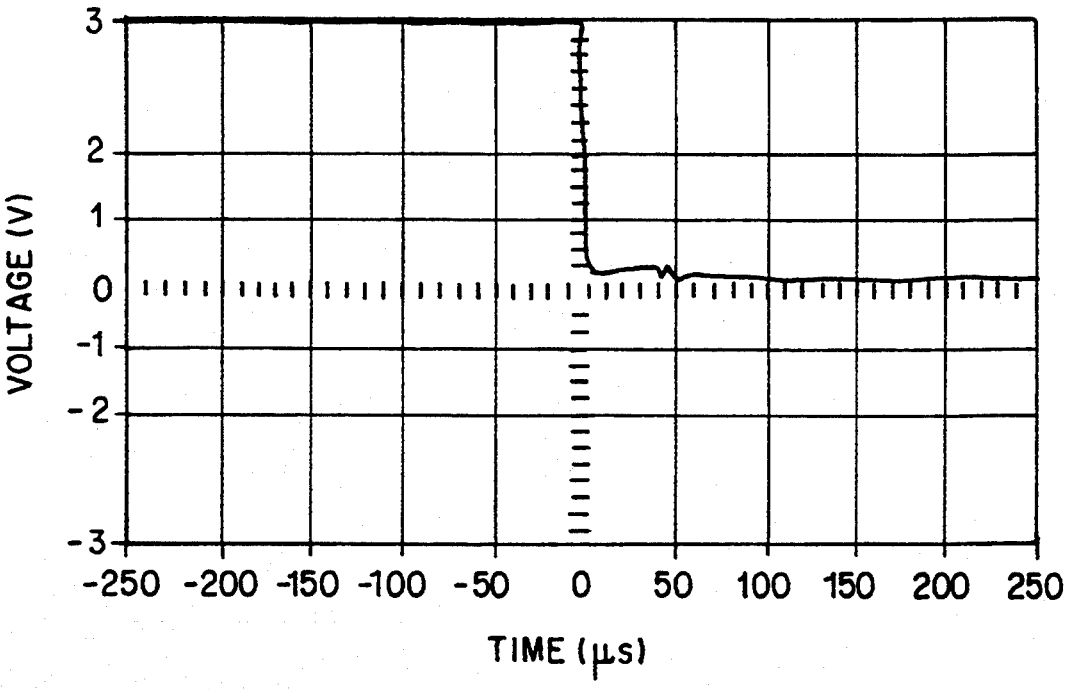
FIG. 15 is a graph illustrating the output waveform with the active interface circuit in place.

Carbon fiber switch configurations of the type described herein, because of their chemical makeup and highly redundant nature, provide a means for making high reliability electrical contacts. However, the addition of the active chip level interfacing circuit 126 (FIG. 9) or 102 (FIG. 8) enables further improvements to be made in the applicability of carbon fiber switch configurations as sensors and switches. The interface circuit 126 or 102 shapes the waveform emanating from the fibers and provides a predictable, sharp switching response on one of two levels due to the squaring nature of its input circuitry. FIG. 14 illustrates the output waveform of the fiber falling on the opposing contact without the active interface circuit, and FIG. 15 illustrates the output waveform with the active interface circuit in place. Due to their very high input resistance, only picoamperes are required to change the state of the interface device between the two levels, so that it is capable of making a transition with as little as a single fiber making contact. The interface circuit 126 or 102 thus enables these sensors and switches to exhibit standard output responses identical with logic level devices, and provide electrically clean output waveforms which are immediately compatible with most microprocessor inputs. The combination with active devices allows the integration of the chip interface with the fiber switch which then provides a "stand alone" component that does not require any further signal processing. In this same vein, it is also possible to integrate more complex signal processing and detection circuitry for more sophisticated sensing devices.

Figure 12:
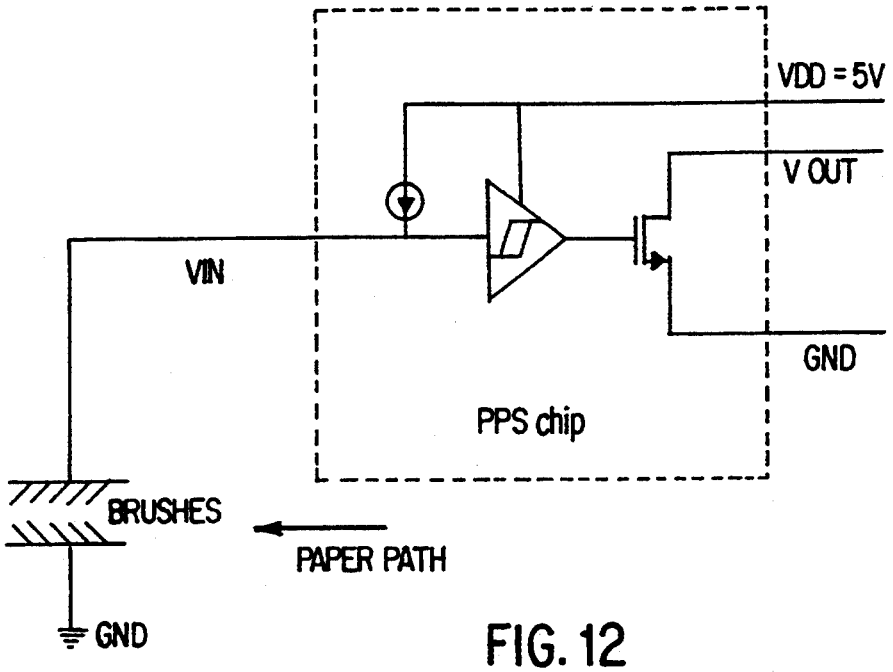
FIG. 12 is an exemplary functional schematic of the active interface circuit of FIGS. 8 and 9.
Figure 13:
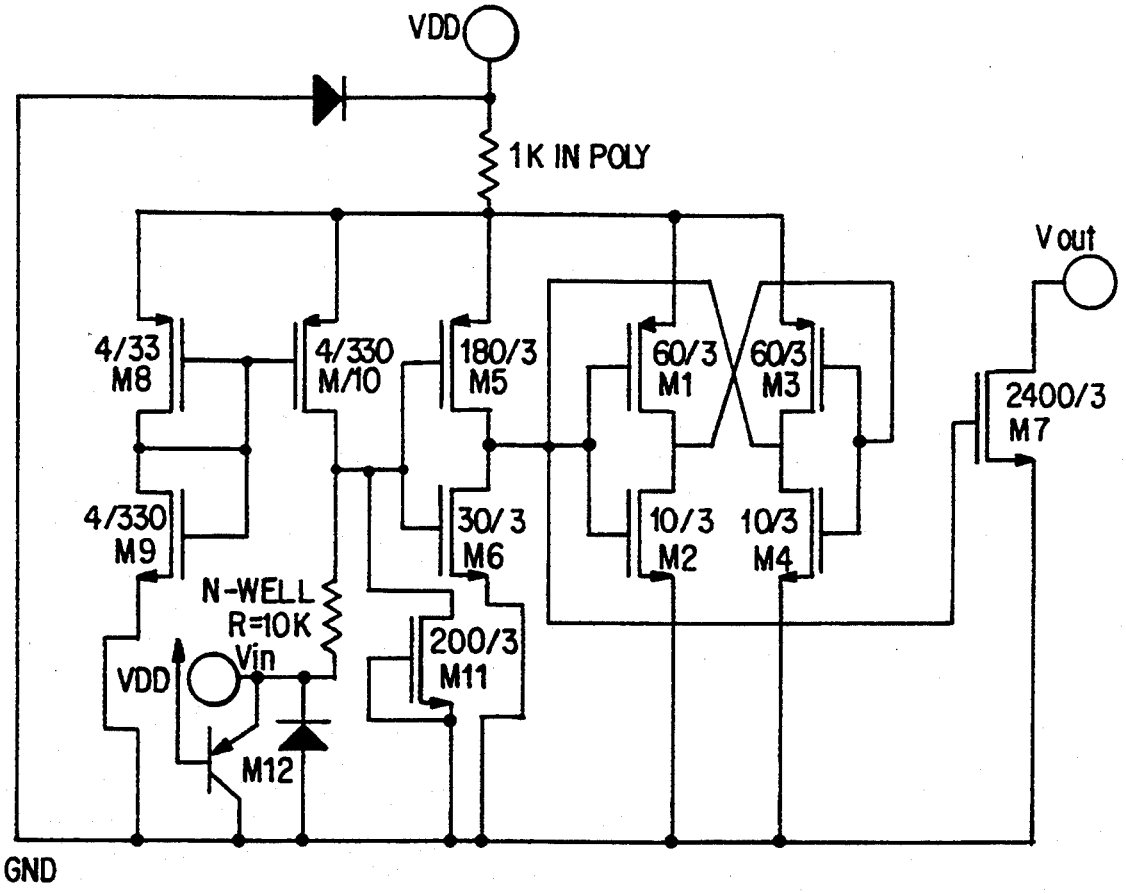
FIG. 13 is an exemplary circuit schematic of the active interface circuit.

FIG. 12 illustrates an exemplary functional schematic of the active interface circuit, which includes an amplifier having hysteresis. FIG. 13 illustrates an exemplary circuit schematic employing field effect transistors (FET) and static input protection having a diode and bipolar transistor for withstanding static discharge from the passing paper.

In the operation of the circuit of FIG. 13, input signal $V_{in}$ is applied to CMOS amplifier/inverter made from transistors M5 and M6. It will be appreciated that transistors M8–M11 form an input bias network and transistor M12 and parallel diode together with N-well resistor form an input protection circuit. The output of CMOS inverter MS/M6 drives a RS flip-flop made from transistors M1–M4. It will be appreciated that the output of the inverter formed from transistors M3 and M4 drives output transistor M7. The bistable nature of the RS flip-flop gives the circuit of FIG. 13 the necessary hysteresis. Finally the 1KΩ in poly resistor and the diode between GND and VDD provide the circuit with protection from electrostatic discharge or other voltage transients on its power supply terminals.

Figure 10:
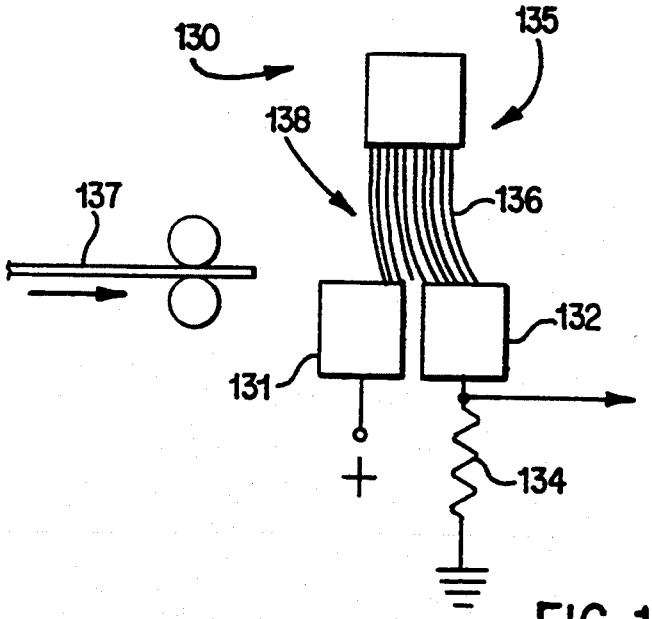

Another sensor device embodiment 130 is shown in FIG. 10 in which a conductive path is established on a single side of the sensor device 130. More particularly, a pair of contact pads 131 and 132 are provided on the bottom side of the sensor device 130, the contact pad 131 being connected to a source of potential, and the contact pad 132 being connected via a sense resistor 134 to ground. A pultrusion 135, carried on a frame (not shown) has conductive fibers 136 at a fibrillated end thereof that extend across the detection zone 138 to contact both of the contacts pads 131 and 132. The two pads 131 and 132 are spaced apart so that absent the contact by the fibers 136 of the pultrusion 135 there is no current path between the two pads 131 and 132.

However, by virtue of the contact to both of the pads 131 and 132 by the fibers 136 of the pultrusion 135 a current path is established therebetween, and current will flow from one pad 131 to the other pad 132. When the pultrusion fibers are moved by a sheet of paper 137 or other object passing in the detection zone 138 over the pads 131 and 132, however, the fibers 136 of the pultrusion 135 are displaced, and the circuit between the two pads 131 and 132 is interrupted. The change in voltage on the sense resistor 134 can therefore be detected to thereby indicate the presence of the sheet of paper 137 or other item within the detection zone 138.

Figure 11:
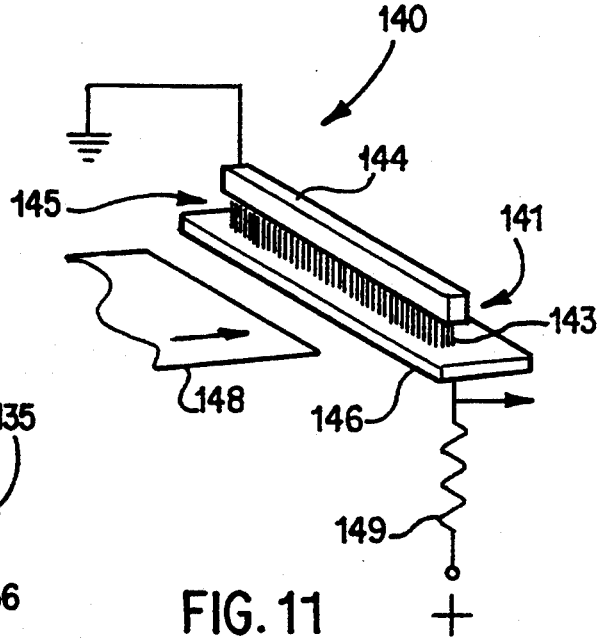
FIG. 11 is a perspective view of another embodiment of a switch or sensor for sensing the presence of a sheet of paper which serves also to establish a charge on the paper or to eliminate any static charges on the paper.

Another embodiment 140 of the invention is shown in FIG. 11. The embodiment shown is similar in operation to the embodiment described above with reference to FIG. 9, and includes a pultrusion 141 that is elongated along one dimension. The pultrusion 141 has a plurality of electrically conductive fibers 143 carried by a host material 144, supported so that the fibers 143 extend across the detection zone 145 to contact a contact plate 146. As before, when a sheet of paper 148, or other item, is moved through the detection zone 145, the fibers 143 are displaced, interrupting the electrical circuit and producing a voltage change on sense resistor 149.

The pultrusion 141 and the conductive fibers are elongated essentially across the width of the detection zone 145, as shown, and therefore contact virtually the entire surface of the paper 148 as it is transported through the detection zone 145. Since the fibers 143 are connected to a reference potential, or ground, as shown, any static charge that may exist on the paper 148 is discharged as the paper traverses the detection zone 145. If desired, the fibers 143 can be connected to a reference potential other than ground so that a controlled charge can be introduced onto the paper 148 as it traverses the detection zone 145.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

What is claimed is:

1. An electronic device for conducting electric current comprising:

first and second electronic contacts, at least the first electronic contact comprising a pultrusion including a plurality of electrically conductive fibers and a host material carrying said plurality of fibers, one end of said pultrusion having a fibrillated end portion to provide selective electrical connection to said second electronic contact, and active interface circuit means electrically connected between the electronic contacts for providing an output signal in one of two states.

2. The electronic device of claim 1 wherein the first and second electronic contacts define a switch wherein the one of the first and second electronic contacts is movable into and out of electrical connection with the other of the first and second electronic contacts.

3. The electronic device of claim 2 wherein the first electronic contact is moved into and out of electrical connection with the second electronic contact.

4. The electronic device of claim 1 wherein the first and second electronic contacts define a sensor for detecting the presence of an article in a detection zone, the first electronic contact being located on one side of the detection zone with the fibrillated end portion extending across the detection zone in electrical connection with the second electronic contact, the fibrillated end portion being selectively displaced by the article when the article is present in the detection zone to selectively interrupt the electrical connection between the first and second electronic contacts.

5. An electronic switch, comprising:

two electronic contacts;

one of said electronic contacts comprising a pultrusion including a plurality of electrically conductive fibers and a host material carrying said plurality of fibers, one end of said pultrusion having a fibrillated end portion to provide electrical connection;

one of said electronic contacts being movable into and out of electrical connection with another of said contacts; and active interface circuit means electrically connected between the contact and pultrusion for providing an output signal in one of two states.

6. The switch of claim 5 wherein said one of said electronic contacts comprising a pultrusion is movable into and out of electrical connection with another of said contacts.

7. The switch of claim 5 wherein said host material is a polyimide composition.

8. The switch of claim 5 wherein said host material volatilizes rapidly and cleanly upon direct exposure to a laser beam of predetermined energy.

9. The switch of claim 5 wherein said host material is a polymer selected from the group consisting of low molecular weight polyethylene, polypropylene, polystyrene, polyvinylchloride, and polyurethane.

10. The switch of claim 5 wherein said continuous strand fibers are carbon fibers.

11. An electronic sensor for detecting the presence of an article in a detection zone, comprising:

a contact at one side of said detection zone;

a pultrusion including a plurality of electrically conductive fibers and a host material carrying said plurality of fibers, supported at another end of said detection zone;

one end of said pultrusion having a fibrillated end portion extending across said detection zone in electrical connection with said contact;

said fibrillated end portion being displaced by said article when said article is present in said detection zone to disconnect said electrical connection; and active interface circuit means electrically connected between the contact and pultrusion for providing an output signal in one of two states.

12. The sensor of claim 11 wherein said article is a sheet of material.

13. The sensor of claim 12 wherein said sheet of material is a sheet of paper.

14. The sensor of claim 11 wherein said detection zone is elongated in one direction, and said pultrusion is elongated to extend along said direction.

15. The sensor of claim 14 wherein said article is a sheet of material.

16. The sensor of claim 15 wherein said sheet of material is a sheet of paper.

17. The sensor of claim 16 wherein when said contact is connected to a source of electrical potential and said conductive fibers of said pultrusion are connected to a reference potential, and when said sheet of paper is transported through said detection zone, said conductive fibers serve to establish the reference potential on said sheet of paper.

18. The sensor of claim 17 wherein said reference potential is ground, and when said sheet of paper is transported through said detection zone, said conductive fibers serve to discharge any static charges existing on said sheet of paper.

19. The sensor of claim 11 further comprising a second contact at said one side of said detection zone, and wherein said fibrillated end portion extending across said detection zone is in electrical connection with said first mentioned and said second contacts completing an electrical flow path therebetween, and wherein when said article is transported through said detection zone, said fibrillated end portion is displaced by said article to interrupt said electrical flow path.

20. The sensor of claim 19 wherein said article is a sheet of material.

21. The sensor of claim 20 wherein said sheet of material is a sheet of paper.

22. The sensor of claim 21 wherein said conductive fibers of said pultrusion are connected to ground, and when said sheet of paper is transported through said detection zone, said conductive fibers serve to discharge any static charges existing on said sheet of paper.

23. The sensor of claim 11 wherein said host material is a polyimide composition.

24. The sensor of claim 11 wherein said host material volatilizes rapidly and cleanly upon direct exposure to a laser beam of predetermined energy.

25. The sensor of claim 11 wherein said host material is a polymer selected from the group consisting of low molecular weight polyethylene, polypropylene, polystyrene, polyvinyichloride, and polyurethane.

26. The sensor of claim 11 wherein said conductive fibers are carbon fibers.

27. An electronic paper path switch, comprising:

a contact at one side of a paper detection zone;

a pultrusion including a plurality of electrically conductive fibers and a host material carrying said plurality of fibers, supported at another end of said paper detection zone;

one end of said pultrusion having a fibrillated end portion extending across said paper detection zone in electrical connection with said contact;

said fibrillated end portion being displaced when a sheet of paper is present in said paper detection zone to disconnect said electrical connection; and active interface circuit means electrically connected between the contact and pultrusion for providing an output signal in one of two states.

28. The sensor of claim 27 wherein said paper detection zone is elongated in one direction transverse to a direction in which said sheet of paper traverses said paper detection zone, and said pultrusion is elongated to extend along said direction.

29. The sensor of claim 28 wherein when said contact is connected to a source of electrical potential and said conductive fibers of said pultrusion are connected to a reference potential, and when said sheet of paper is transported through said detection zone, said conductive fibers serve to establish the reference potential on said sheet of paper.

30. The sensor of claim 29 wherein said reference potential is ground, and when said sheet of paper is transported through said detection zone, said conductive fibers serve to discharge any static charges existing on said sheet of paper.

31. The sensor of claim 27 further comprising a second contact at said one side of said detection zone, and wherein said fibrillated end portion extending across said detection zone is in electrical connection with said first mentioned and said second contacts completing an electrical flow path therebetween, and wherein when said article is transported through said detection zone, said fibrillated end portion is displaced by said article to interrupt said electrical flow path.

32. The sensor of claim 31 wherein said conductive fibers of said pultrusion are connected to ground, and when said sheet of paper is transported through said detection zone, said conductive fibers serve to discharge any static charges existing on said sheet of paper.

33. The sensor of claim 27 wherein said host material is a polyimide composition.

34. The sensor of claim 27 wherein said host material volatilizes rapidly and cleanly upon direct exposure to a laser beam of predetermined energy.

35. The sensor of claim 27 wherein said host material is a polymer selected from the group consisting of low molecular weight polyethylene, polypropylene, polystyrene, polyvinylchloride, and polyurethane.

36. The sensor of claim 27 wherein said conductive fibers are carbon fibers.

* * * * *